US005655585A

United States Patent [19]

Fry

[11] Patent Number: 5,655,585

[45] Date of Patent: Aug. 12, 1997

[54] STEEL REINFORCED ROLL-UP INDUSTRIAL DOOR SUBSTRATE FABRIC

[75] Inventor: Ted Fry, Summerville, S.C.

[73] Assignee: Asten, Inc., Charleston, S.C.

[21] Appl. No.: 637,480

[22] Filed: Apr. 25, 1996

[51] Int. Cl.[6] ..... G08B 13/08

[52] U.S. Cl. ..... 160/10; 160/238; 160/DIG. 7; 139/425 R

[58] Field of Search ..... 160/10, 23.1, 238, 160/237, 264, DIG. 7, 127; 139/425 R, 425 A; 340/545, 547, 541, 550

[56] References Cited

U.S. PATENT DOCUMENTS

| | | | |
|---|---|---|---|
| 1,983,617 | 12/1934 | Ladon | 139/425 R X |
| 3,077,947 | 2/1963 | Peebles et al. | 139/425 R X |
| 3,231,042 | 1/1966 | Chapman | 139/425 R X |
| 3,583,465 | 6/1971 | Youngs et al. | 160/264 |
| 3,696,373 | 10/1972 | Dunn et al. | 160/10 X |
| 4,002,188 | 1/1977 | Hanks | 139/425 R X |
| 4,232,310 | 11/1980 | Wilson | 160/10 X |
| 4,312,913 | 1/1982 | Rheaume | 139/425 R X |
| 4,736,785 | 4/1988 | Seuster | 160/264 |
| 4,788,088 | 11/1988 | Kohl | 428/34.5 |
| 4,889,176 | 12/1989 | Nilsson | 160/264 |
| 4,974,658 | 12/1990 | Komatsu et al. | 160/310 |
| 5,078,197 | 1/1992 | Weishar | 160/265 |
| 5,097,885 | 3/1992 | Kitagawa | 160/238 X |
| 5,103,208 | 4/1992 | Riordan | 160/10 X |
| 5,139,074 | 8/1992 | Warner | 160/271 |
| 5,222,541 | 6/1993 | Hornberger | 160/265 |
| 5,274,357 | 12/1993 | Riordan | 160/10 X |
| 5,353,858 | 10/1994 | Hartmann | 160/10 X |
| 5,450,880 | 9/1995 | Schwartzman et al. | 160/10 |

*Primary Examiner*—David M. Purol
*Attorney, Agent, or Firm*—Volpe and Koenig, P.C.

[57] ABSTRACT

A flexible roll up industrial door which includes a multilayered door closure fabric. The fabric includes conductive reinforcing yarns embedded within the layers of the fabric such that the conductive reinforcing yarns do not rise to the surface of the fabric. The embedding of the conductive reinforcing yarns within the multilayered fabric serves to both protect and at least partially conceal the conductive reinforcing yarns.

18 Claims, 4 Drawing Sheets

STEEL REINFORCED ROLL-UP INDUSTRIAL DOOR SUBSTRATE FABRIC

BACKGROUND OF THE INVENTION

1. Field of the Invention

This invention relates to roll-up industrial doors and in particular to roll-up industrial doors made from a woven fabric.

2. Description of Related Art

Roll-up doors typically are used in commercial or industrial establishments to separate different areas of a building or to separate the inside of the building from the exterior. For example, roll-up doors may be used to separate two areas or zones which have different temperature or humidity conditions. Roll-up doors are also used to provide noise and/or security control between two areas. A roll-up door has the advantage of being capable of being moved rapidly between the open and closed positions. In opening the door, the door panel or curtain is typically wound on a drum located above the doorway.

Conventional roll-up doors include a counterbalancing mechanism to counterbalance the weight of the door panel. Conventional roll-up doors also incorporate a tensioning system which is arranged to exert a downward force on the door panel to stretch the door panel when in the closed or partially closed positions.

Roll-up doors may be power operated and include a drive mechanism. Operation of the drive mechanism in one direction will uncoil a door panel from a drum to move the panel to a closed position. Operation of the drive mechanism in the opposite direction acts to wind the panel on the drum and move the door panel to an open position.

Conventional metallic roll-up doors are expensive, cumbersome and easily susceptible to denting of the door material. Non-metallic roll-up industrial doors are made by coating a synthetic fabric with a PVC or other suitable resin. Such doors provide limited security advantages in contrast to roll-up metal doors. However, fabric door panels generally provide a more attractive appearance. Also, due to the flexible nature of a fabric door panel, fabric panels are less susceptible to denting or other damage as compared to a rigid door panels.

It would be desirable to provide a roll-up door which is flexible, light, simple to manufacture and offers increased security features.

SUMMARY OF THE INVENTION

The invention is directed to a flexible roll-up door which comprises a substrate fabric made of woven monofilament yarns reinforced with metal wires.

It is an object of the invention to provide a reinforced flexible door substrate fabric which is tamper and cut resistant.

It is a further object of the invention to provide an electrical alarm signal through the reinforcing wire of the substrate fabric.

Other objects and advantages will become apparent to those skilled in the art from the following detailed description of presently preferred embodiments.

DETAILED DESCRIPTION OF THE PREFERRED EMBODIMENT

Figure 1:
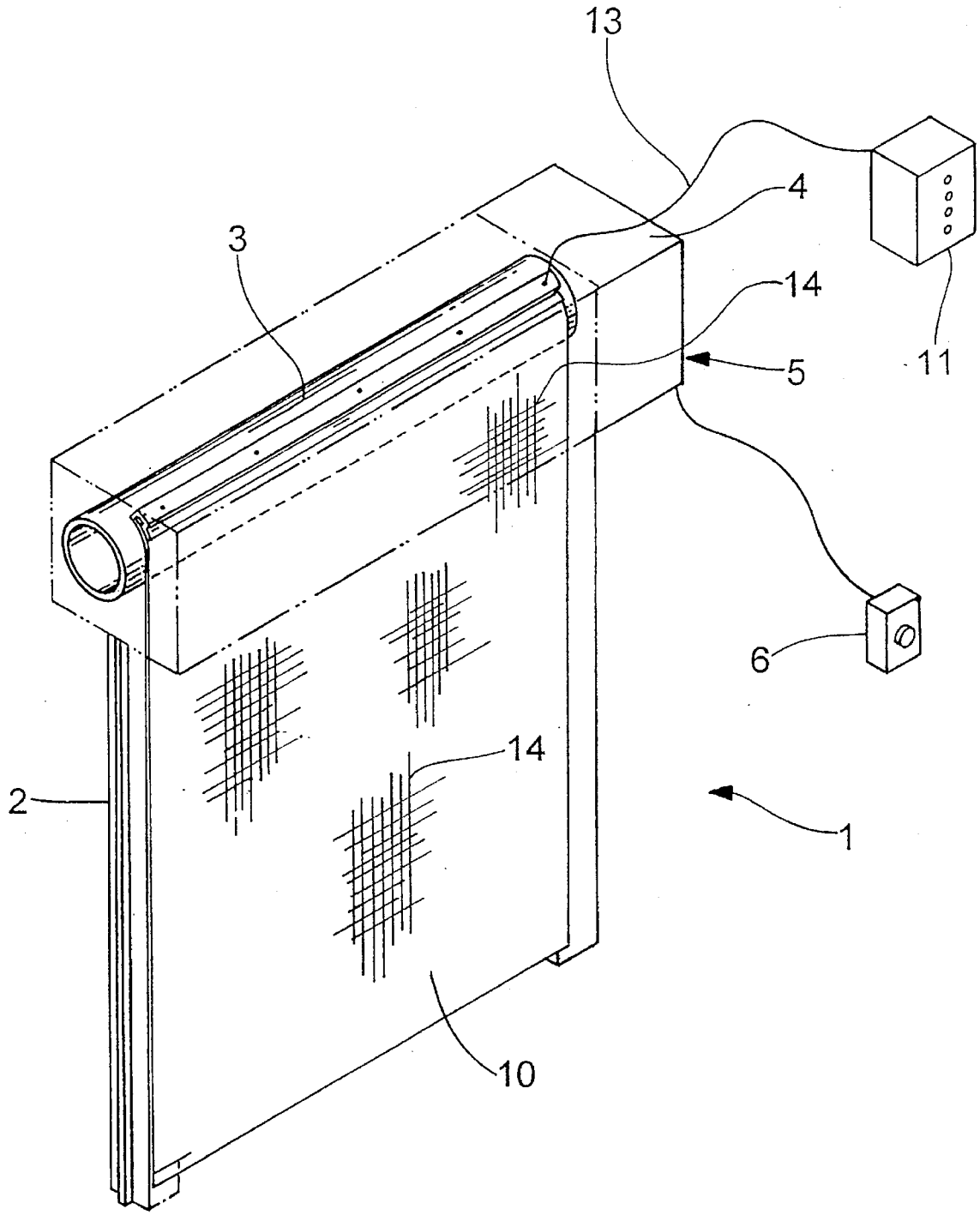
FIG. 1 is an elevated view of a roll-up door substrate fabric incorporated into a roll-up door.
Figure 2:
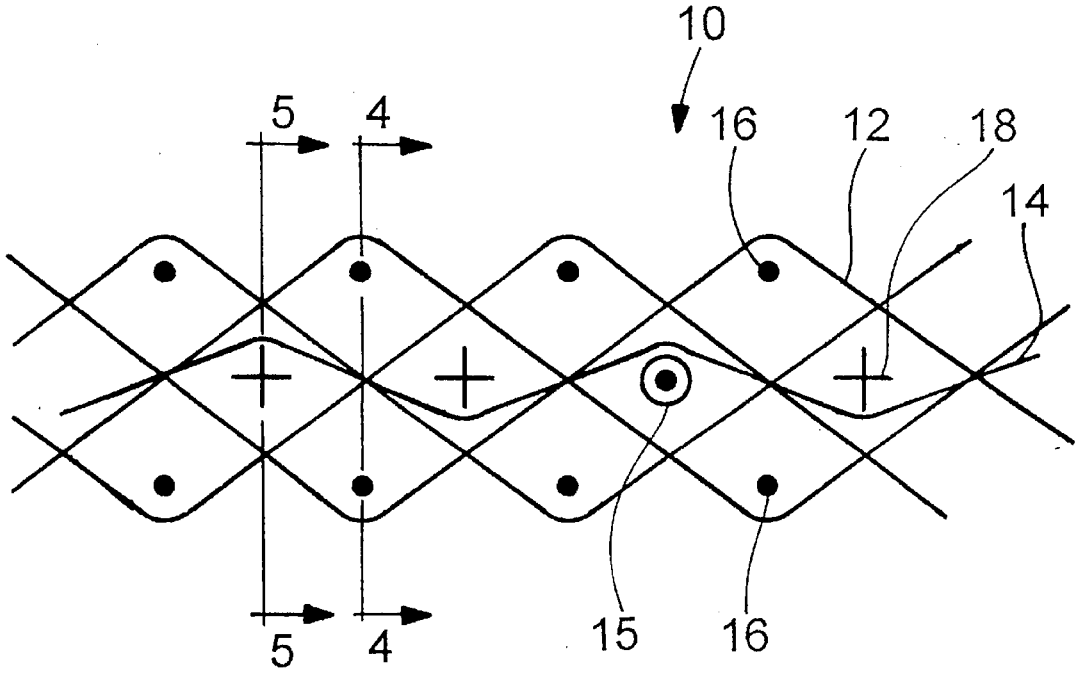
FIG. 2 is a schematic diagram of the weave structure of a roll-up door substrate fabric according to the preferred embodiment.
Figure 4:
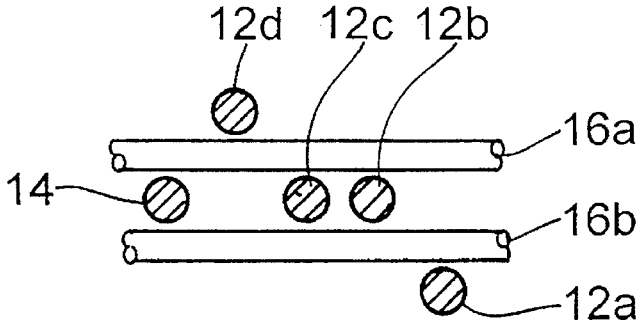
FIG. 4 is a view along line 4—4 in FIG. 2.
Figure 5:
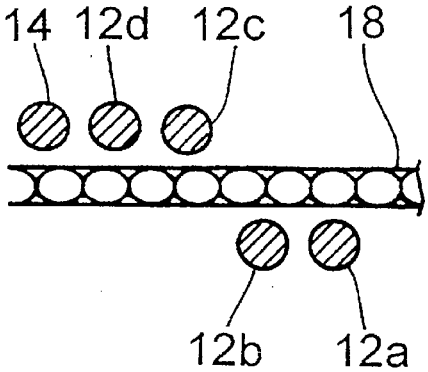
FIG. 5 is a view along line 5—5 in FIG. 2.

Referring to FIG. 1, a roll up door i is shown mounted in a doorway 2. The roll-up door I includes a drum 3 which is rotationally operated by a driver mechanism 4 with a security cover 5. A key-switch 6 or the like is associated with the drive mechanism to control the rotation of the drum 3 to coil and uncoil a door substrate fabric 10 thereby opening and closing the door 1.

Referring to FIGS. 2–5, the weave structure is shown of a preferred embodiment of the flexible roll-up door substrate fabric 10. The substrate fabric 10 is preferably woven in a conventional double layer weave having a warp system of four repeating warp yarns 12*a–d* and two layers of weft yarns 16*a*, 16*b*. The face and back layers of weft yarns 16*a* and 16*b* are stacked in vertical alignment. The weave pattern of warp yarns 12*a–d* is best seen in FIGS. 3*a–d*. The repeat is staggered to produce a crow foot weave, but a twill repeat pattern may also be used.

In the preferred embodiment, the warp yarns 12 are woven 48 yarns per inch using 0.5 mm diameter polyester yarns. Preferably, the face and back layers of weft yarns 16*a*, 16*b* are woven 18 yarns per inch in each layer using 0.5 mm polyester yarns.

Door panel fabrics comprising all synthetic fabrics woven in a two-layer weave are known in the art. In contrast, the door panel fabric of the present invention includes stuffer yarns incorporated into the weave which define a middle layer. The stuffer yarns comprise wire yarn 15 and synthetic yarns 18 which are preferably woven with the same number of yarns per inch as the weft yarns 16*a*, 16*b*, but may be woven at a lesser density such that not all the natural voids defined by the conventional two layer weave are filled. The wires 15 are generally woven not less than one nor more than four wire yarns per inch of the fabric 1. Preferably, the filling wires 15 are 0.020" S.S. wire and are woven 2 yarns per inch being every ninth stuffer yarn in the weave repeat. The synthetic stuffer yarns 18 are preferably made of a non-spun material such as cabled, hollow or standard monofil, a preferred yarn is 0.2 mm/2/2 cabled polyester. The stuffer yarns 18 are preferably woven 16 yarns per inch.

Figure 3A:
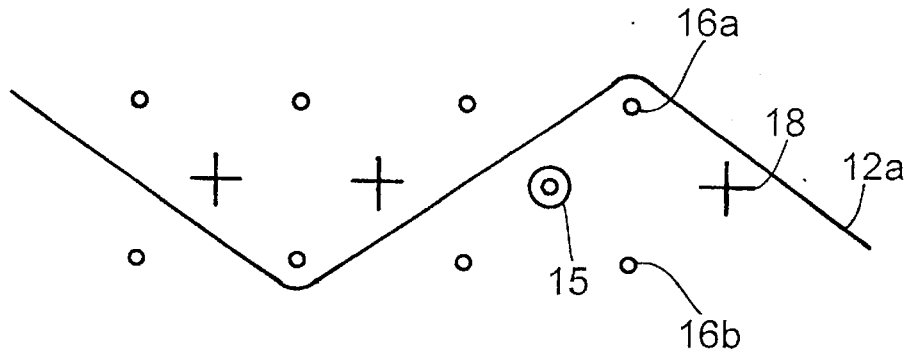
FIG. 3*a* is a schematic diagram of the weave structure of the substrate fabric showing a first warp yarn.
Figure 3B:
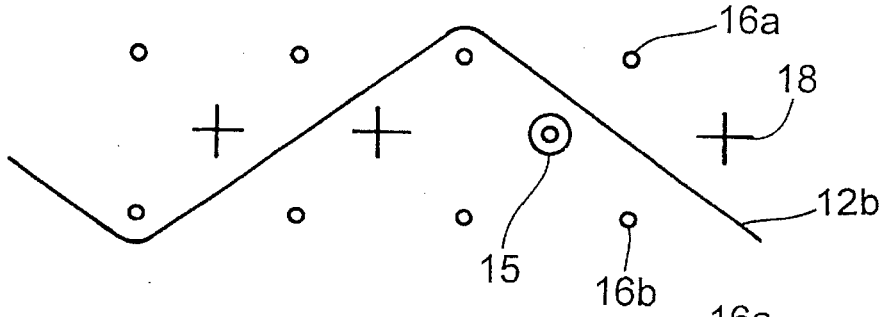
FIG. 3*b* is a schematic diagram of the weave structure of the substrate fabric showing a second warp yarn.
Figure 3C:
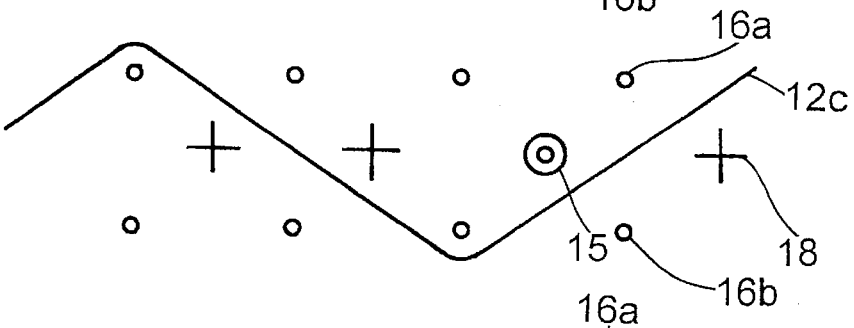
FIG. 3*c* is a schematic diagram of the weave structure of the substrate fabric showing a third warp yarn.
Figure 3D:
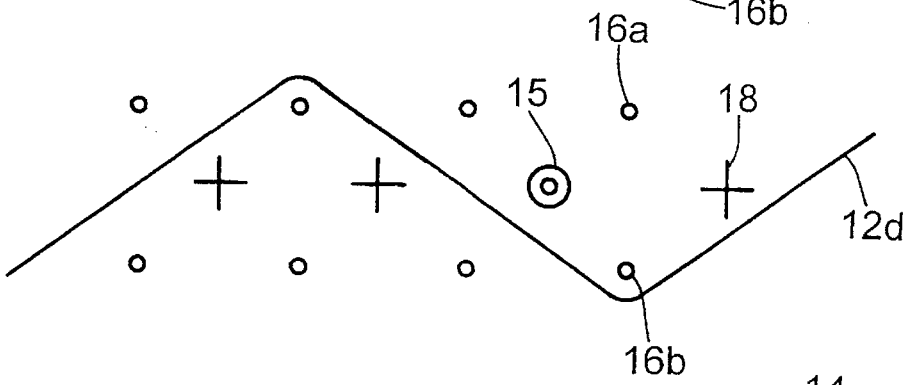
FIG. 3*d* is a schematic diagram of the weave structure of the substrate fabric showing a fourth warp yarn.
Figure 3E:
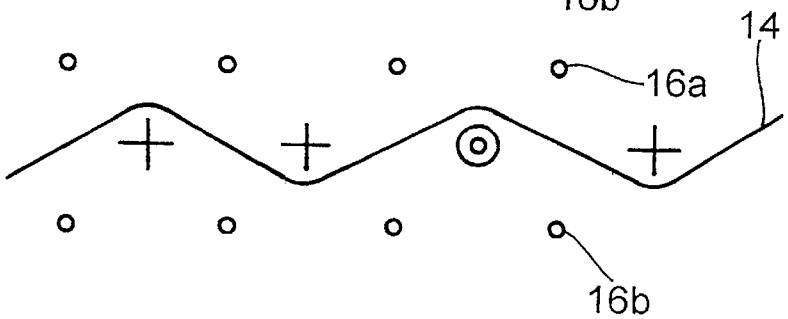
FIG. 3*e* is a schematic diagram of the weave structure of the substrate fabric showing a reinforcing wire.

As best seen in FIG. 3*e*, the fabric substrate 10 also includes a reinforcing warp wire 14 woven in a plain weave pattern about the stuffer yarns 15, 18. The warp wires 14 are woven so as to not protrude from either surface of the fabric 10, consistently passing between the face and back weft yarns 16*a*, 16*b*. The wire warp yarns 14 are generally woven in the warp system at not less than one nor more than four per inch of fabric width. Preferably, the reinforcing warp wires 14 are woven 2 ends per inch, i.e. as every 25th warp yarn in the repeat, from 0.020" S.S. wire.

The preferred embodiment of the fabric 10 illustrated in FIGS. 2–5, provides cut resistancy in both the warp and weft directions. Accordingly, the use of reinforcing wire in both the warp and weft directions provides additional security in that the fabric cannot be cut in any direction without severing at least some of the reinforcing wires.

As further shown in FIG. 1, an electronic security system 11 having sensor leads 13 may be operatively associated with metal wires 14, 15 incorporated into the woven substrate fabric 10. The metal yarns 14, 15 in one direction may be covered with a non-conductive sheath to insulate and protect against interference when connected to the security system 11. In operation, if one or more of the metal yarns 14, 15 of substrate fabric 10 are severed, the alarm system 11 is activated. Such security systems capable of detecting a break in a wire are well known in the art.

Figure 6:
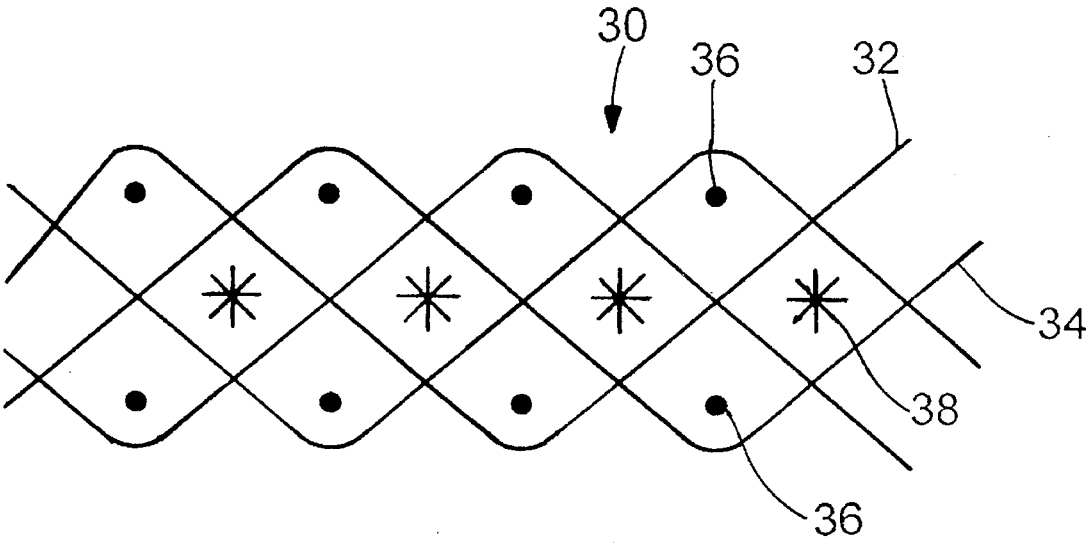
FIG. 6 is a schematic diagram of the weave structure of a second embodiment of the roll-up door substrate fabric.
Figure 7:
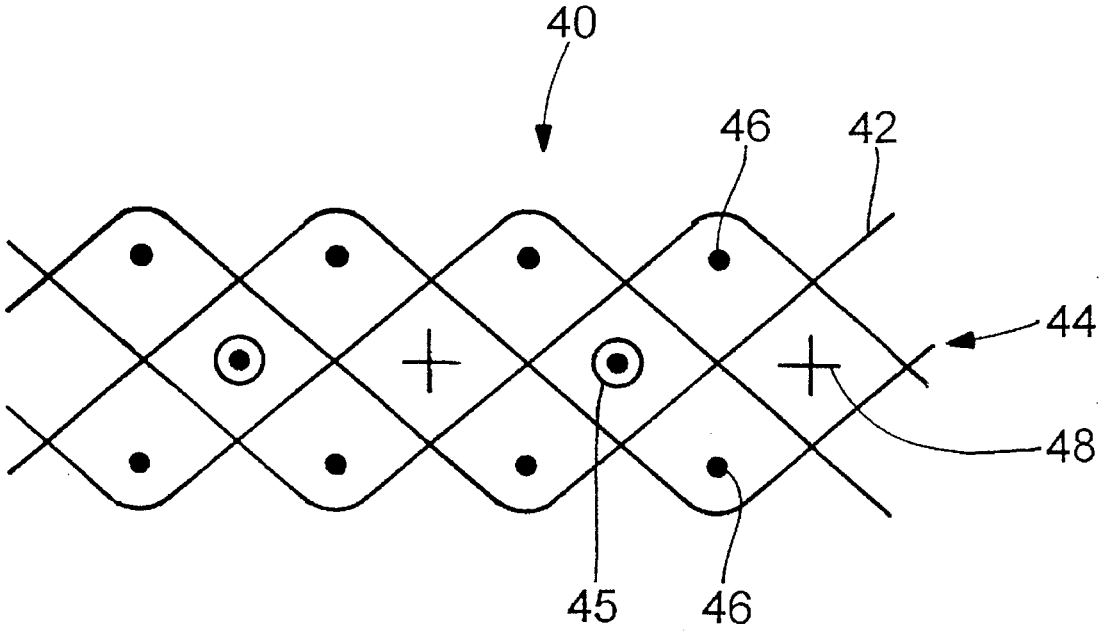
FIG. 7 is a schematic diagram of the weave structure of a third embodiment of the roll-up door substrate fabric.

Two alternate embodiments are shown in FIGS. 6 and 7. As described above, the substrate fabric 10 is preferably woven in a conventional double layer weave having a warp system of four repeating warp yarns, two layers of weft yarns to define the face and back of the fabric and an intermediate layer of stuffer yarns disposed within the naturally occurring voids of the double layer weave. A second embodiment of a fabric 30 for the roll-up door is shown in FIG. 6. The fabric 30 is comprised of a system of warp yarns 32 which interweave with two stacked layers of weft yarns 36. In this embodiment, reinforcing wires are only incorporated in the warp. Reinforcing warp wire 34 is woven about a middle filling layer made entirely of spun polyester yarns 38. The warp wire 34 weaves in a plain repeat pattern under and over successive middle filling yarns 38 throughout the length of the fabric 34. The warp wires 34 weave between face and back weft layer yarns 36 such that they do not protrude from the face or the back of the fabric 30. The warp wires 34 are preferably constructed of a 4 ends per inch from 0.020" S.S. wire.

In the third embodiment, shown in FIG. 7, reinforcing wires are only incorporated in the weft of fabric 40. Fabric 40 comprises a system of warp yarns 42 interwoven with two stacked layers of yarns 46. The warp yarns 42 are preferably 0.5 mm monofilament polyester yarns woven 48 yarns per inch. The face and back layer weft yarns are preferably 0.5 mm monofilament polyester yarns woven 19 yarns per inch in each layer. A layer of stuffer yarns 44 is provided comprising 0.2 mm/2/2 cabled polyester yarns 48 alternating with reinforcing single strand 0.020" S.S. wires 45.

While the present invention has been described in terms of the preferred embodiment and specific weaves, other variations which are within the scope of the invention as defined in the claims will be apparent to those skilled in the art. The same weaves may be obtained in weaving the present warp systems as weft and vice versa. Other weave patterns and yarns may also be employed.

I claim:

1. An industrial fabric for a roll-up industrial door comprising:

a first system of synthetic non-conductive yarns interwoven with a second system of synthetic non-conductive yarns in a selected repeat pattern to define a multilayer fabric having face and back surfaces; and reinforcing electrically conductive yarns interwoven in at least one of said systems such that said reinforcing conductive yarns do not rise to either surface of the fabric.

2. The fabric of claim 1 wherein said reinforcing conductive yarns are interwoven in both said systems of yarns such that said reinforcing conductive yarns do not rise to either surface of the fabric.

3. The fabric according to claim 2 wherein the synthetic yarns are interwoven into a two layer fabric.

4. The fabric of claim 1 wherein said first system synthetic yarns are woven 48 ends per inch from 0.5 mm diameter polyester yarns and said first system includes reinforcing conductive yarns woven 2 ends per inch from 0.020 inch diameter S.S. wire.

5. The fabric of claim 4 wherein said second system includes face and back layers of 0.5 mm polyester monofilament filling yarns, each layer woven 18 yarns per inch.

6. The fabric of claim 5 wherein said second system includes a middle layer of 0.2 mm/2/2 cabled polyester filling yarns and 0.020 inch S.S. wire yarns.

7. The fabric of claim 6 wherein said middle layer filling wire is woven 16 cabled yarns and 2 wire yarns per inch.

8. The fabric of claim 1 wherein said first system of yarns includes face and back layers of synthetic non-conductive yarns, said reinforcing conductive yarns are disposed between said face and back layers in an intermediate layer of yarns, and said intermediate layer of yarns do not rise to either surface of said fabric.

9. The fabric of claim 8 wherein said reinforcing conductive yarns are interwoven in both said systems of yarns such that said reinforcing conductive yarns do not rise to either surface of the fabric.

10. The fabric according to claim 9 wherein the synthetic yarns are interwoven into a two layer fabric.

11. The fabric according to claim 1 wherein the synthetic yarns are interwoven into a two layer fabric.

12. A roll-up industrial door to enclose a doorway in a structure comprising:

a flexible door panel for displacement between a closed position blocking the doorway and an open position coiled on a drum mounted above the doorway;

said panel being comprised of a first system of synthetic yarns interwoven with a second system of synthetic non-conductive yarns in a selected repeat pattern to define a multilayer fabric having face and back surfaces; and reinforcing electrically conductive yarns interwoven with at least one of said systems of synthetic non-conductive yarns.

13. The roll-up industrial door of claim 12 wherein said reinforcing conductive yarns are electrically coupled with an external security system such that said security system senses severance of said conductive yarns.

14. The roll-up industrial door of claim 12 wherein said first system of yarns includes face and back layers of synthetic non-conductive yarns, said reinforcing conductive yarns are disposed between said face and back layers in an intermediate layer of yarns, and said intermediate layer yarns do not rise to either surface of said panel.

15. The roll-up industrial door of claim 14 wherein additional reinforcing conductive yarns are interwoven with said intermediate layer yarns.

16. A roll up industrial door of claim 14 wherein said reinforcing conductive yarns are interwoven in both said systems of yarns such that said reinforcing conductive yarns do not rise to either surface of the fabric.

17. A roll up industrial door of claim 12 wherein said reinforcing conductive yarns are interwoven in both said systems of yarns such that said reinforcing conductive yarns do not rise to either surface of the fabric.

18. The fabric according to claim 17 wherein said synthetic yarns are interwoven into a two layer fabric.

* * * * *

UNITED STATES PATENT AND TRADEMARK OFFICE
CERTIFICATE OF CORRECTION

PATENT NO. : 5,655,585

DATED : August 12, 1997

INVENTOR(S) : Ted Fry

It is certified that error appears in the above-identified patent and that said Letters Patent is hereby corrected as shown below:

ON THE TITLE PAGE

In the references cited, U.S. Patent Documents, delete "5,450,880" and insert --5,450,888-- therefor.

At column 2, line 25, delete "door i" and insert --door 1-- therefor.

At column 2, line 26, delete "door I" and insert --door 1-- therefor.

Signed and Sealed this

Twenty-eighth Day of October, 1997

Bruce Lehman

*Attest:*

BRUCE LEHMAN

*Attesting Officer*

*Commissioner of Patents and Trademarks*